US005095367A

United States Patent [19]

Shimizu

[11] Patent Number: 5,095,367

[45] Date of Patent: Mar. 10, 1992

[54] STILL VIDEO CAMERA WITH HAND STRAP

[75] Inventor: Hitoshi Shimizu, Ohmiya, Japan

[73] Assignee: Asahi Kogaku Kogyo Kabushiki Kaisha, Tokyo, Japan

[21] Appl. No.: 563,186

[22] Filed: Aug. 6, 1990

[30] Foreign Application Priority Data

Aug. 7, 1989 [JP] Japan ..... 1-92211[U]

[51] Int. Cl.[5] ..... H04N 5/225

[52] U.S. Cl. ..... 358/209; 358/909; 358/906; 358/229; 354/295; 354/288

[58] Field of Search ..... 358/209, 229, 909, 906; 354/82, 293, 288 C, 295

[56] References Cited

U.S. PATENT DOCUMENTS 4,348,095 9/1982 Suzuki ..... 354/288 C
4,814,806 3/1989 Flax ..... 354/295

FOREIGN PATENT DOCUMENTS 64-43335 3/1989 Japan .
64-74537 3/1989 Japan .

OTHER PUBLICATIONS

Copy of the English language abstract of Japanese Patent Publication No. 64-74537.

*Primary Examiner*—Howard W. Britton
*Assistant Examiner*—Sherrie Hsia
*Attorney, Agent, or Firm*—Sandler, Greenblum & Bernstein

[57] ABSTRACT

The hand strap of a still video camera is arranged in such a manner that an accessory is detachably provided on the hand strap by means of a connecting member. Thus, it becomes possible to prevent the accessory from being lost. Further, the hand strap, by accommodating a connection cord for connecting the still video camera and the accessory within the hand strap, prevents the connection cord from obstructing the operations of the still video camera.

5 Claims, 4 Drawing Sheets

STILL VIDEO CAMERA WITH HAND STRAP

BACKGROUND OF THE INVENTION

The present invention relates to a still video camera with a hand strap, more particularly to a camera capable of preventing an accessory mounted thereon from being lost.

Known electronic still video cameras have been designed so as to record photographed images on storage medium such as a magnetic disk mounted on a electronic still video camera.

FIG. 1 shows an example of such a still video camera comprising a photographic lens 30, a flash light emitting part 31, a magnetic disk accommodating part 32, a shutter button 33 and similar mechanisms. These operating parts are provided on a camera body 3. Moreover, a detachable audio adaptor 2 is fitted to one side of the camera body 3 of the still video camera so that the sound around the camera can be recorded via a microphone 21.

When no sound is recorded, the audio adapter 2 can be detached from the still video camera. Consequently, the above still video camera becomes lightweight and portable when the audio adaptor 2 is detached from the camera body 3. However, in the above described construction, since the audio adaptor 2 can be detached from the camera body 3 and carried as a separate part by an operator, there is fear of losing the adaptor itself. Furthermore, a photographing opportunity may be lost while the operator looks for the adaptor after having detached it from the camera body 3.

SUMMARY OF THE INVENTION

It is therefore an object of the invention to provide an improved still video camera with hand strap.

For this purpose, according to the present invention, there is provided a still video camera with a hand strap attached to a camera body, the hand strap being arranged in such a manner that a predetermined camera accessory is detachably provided on the hand strap by means of a predetermined connecting member.

DESCRIPTION OF THE ACCOMPANYING DRAWINGS

DESCRIPTION OF THE EMBODIMENTS

Figure 1:
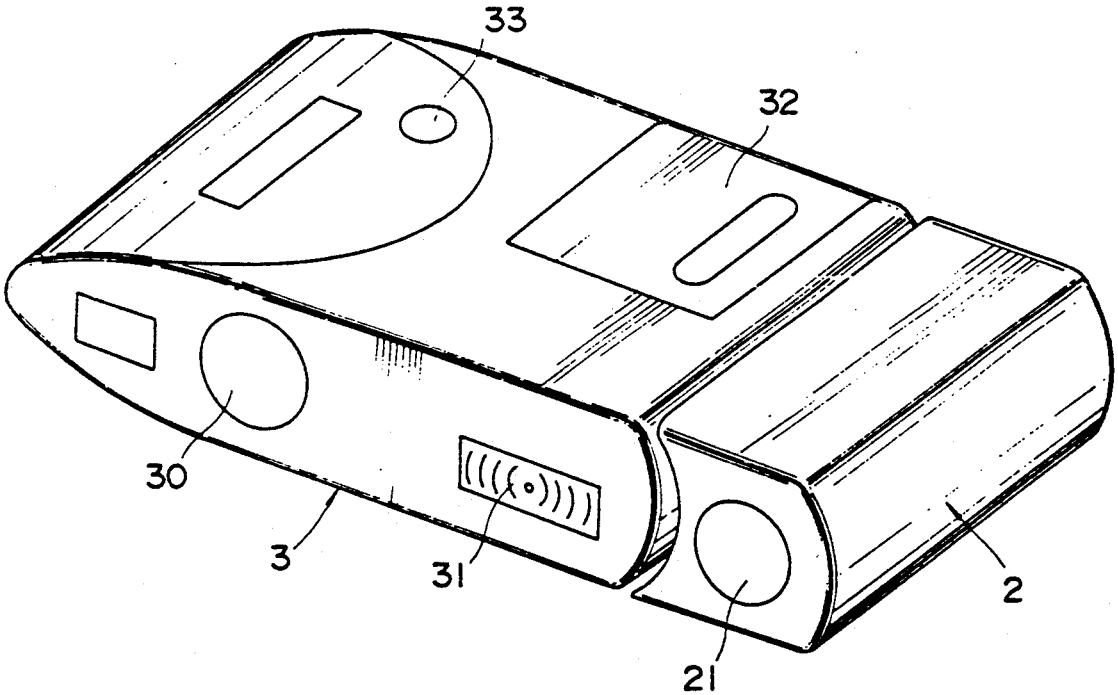
FIG. 1 is a perspective view of a conventional still video camera.

Referring to the drawings of FIGS. 2 and 3, one embodiment of the present invention will be described.

Figure 2:
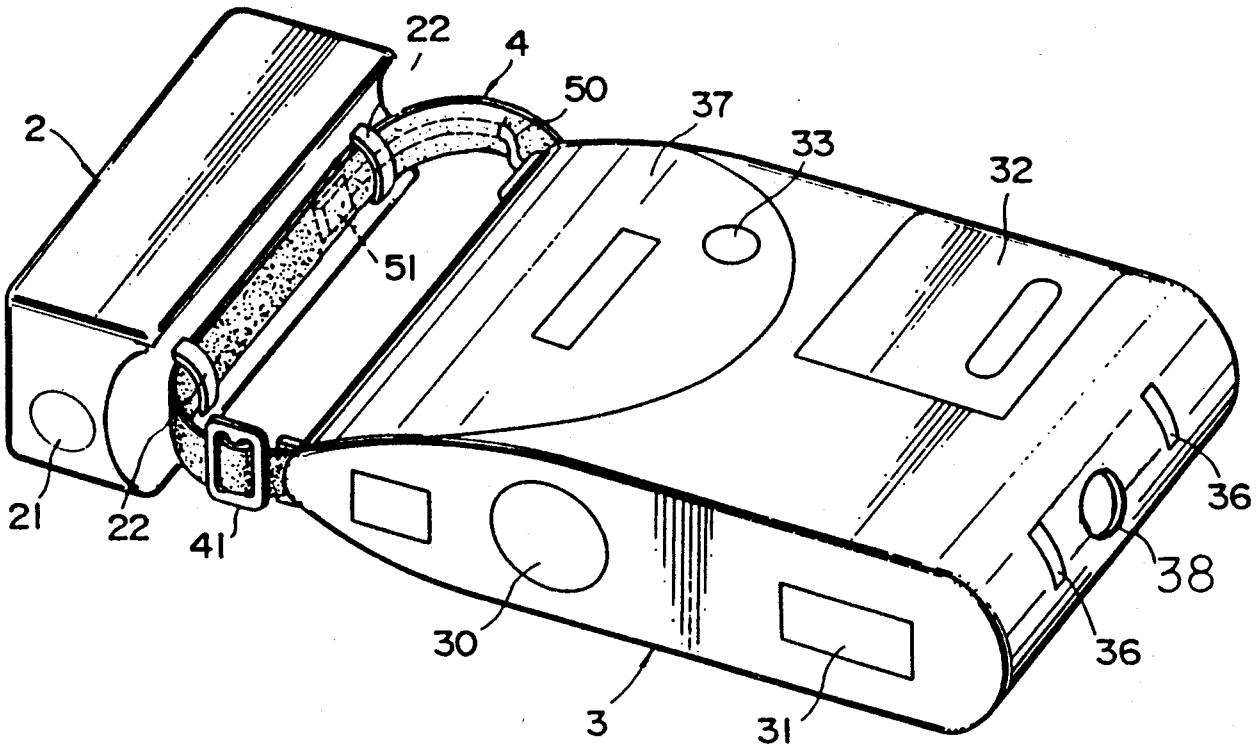
FIG. 2 is a perspective view of a still video camera embodying the present invention.

In FIG. 2, numeral 3 refers to an electronic still video camera body and 2 to an audio adaptor, the arrangement of these components parts being similar to that of the conventional still video camera shown in FIG. 1.

The aforementioned audio adaptor 2 is provided with hooks 22, 22 and can be attachably and detachably mounted on the camera body 3 by plugging the hooks 22, 22 in fitting holes 36, 36 of the camera body 3.

In this embodiment, as shown in FIG. 2, a hand strap 4 is fitted to one side of a grip part 37 of the camera body 3. The hand strap 4 is belt-shaped with both ends fitted via suitable fitting members to the camera body 3. In this case, a suitable adjusting ring 41 is employed to adjust the length of the hand strap 4 in the longitudinal direction thereof. Moreover, the audio adaptor 2 is fitted to the hand strap 4 by the hooks 22, 22.

Figure 3:
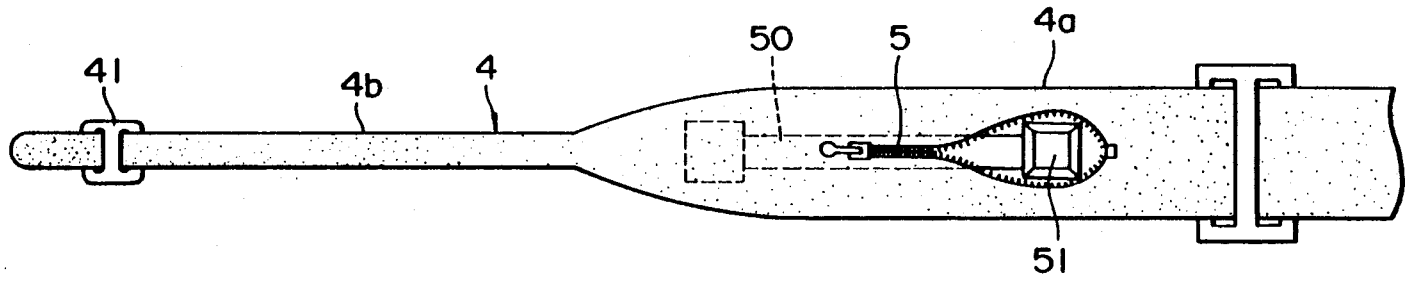
FIG. 3 is a schematic enlarged view of a hand strap provided on the still video camera of FIG. 2.

As shown in FIG. 3, the hand strap 4 has a wide belt portion 4*a* and a narrow belt portion 4*b*, with the wide belt portion 4*a* being bag-shaped. Fasteners 5 are fitted to both the top surface and undersurface of the wide belt portion 4*a* at shifted (i.e., staggered) positions in the longitudinal direction thereof. Within the fasteners 5, a connection cord 50 is contained in the wide belt portion 4*a* of the hand strap. Connectors 51, 51 are provided at both ends of the connection cord 50, respectively. The connectors 51, 51 extend out of the respective surfaces of the hand strap 4 and are connected to the terminals respectively provided on the audio adaptor 2 and the camera body 3.

In this embodiment, the audio adaptor 2 may be removed, if necessary, from the hand strap 4 and directly attached to the camera body 3 as in the conventional case. In this case, the audio adaptor 2 is electrically connected to the camera body 3 through a connector 38.

In FIG. 3, a portion of the hand strap 4 in which the connection cord is provided is arranged to be larger in width direction thereof than that of the other portion because space for accommodating the connection code is needed. However, as shown in FIG. 2, the width of the hand strap can be arranged to be the same throughout the whole length of the hand strap 4, so that well-balanced portability is obtained.

Figure 4:
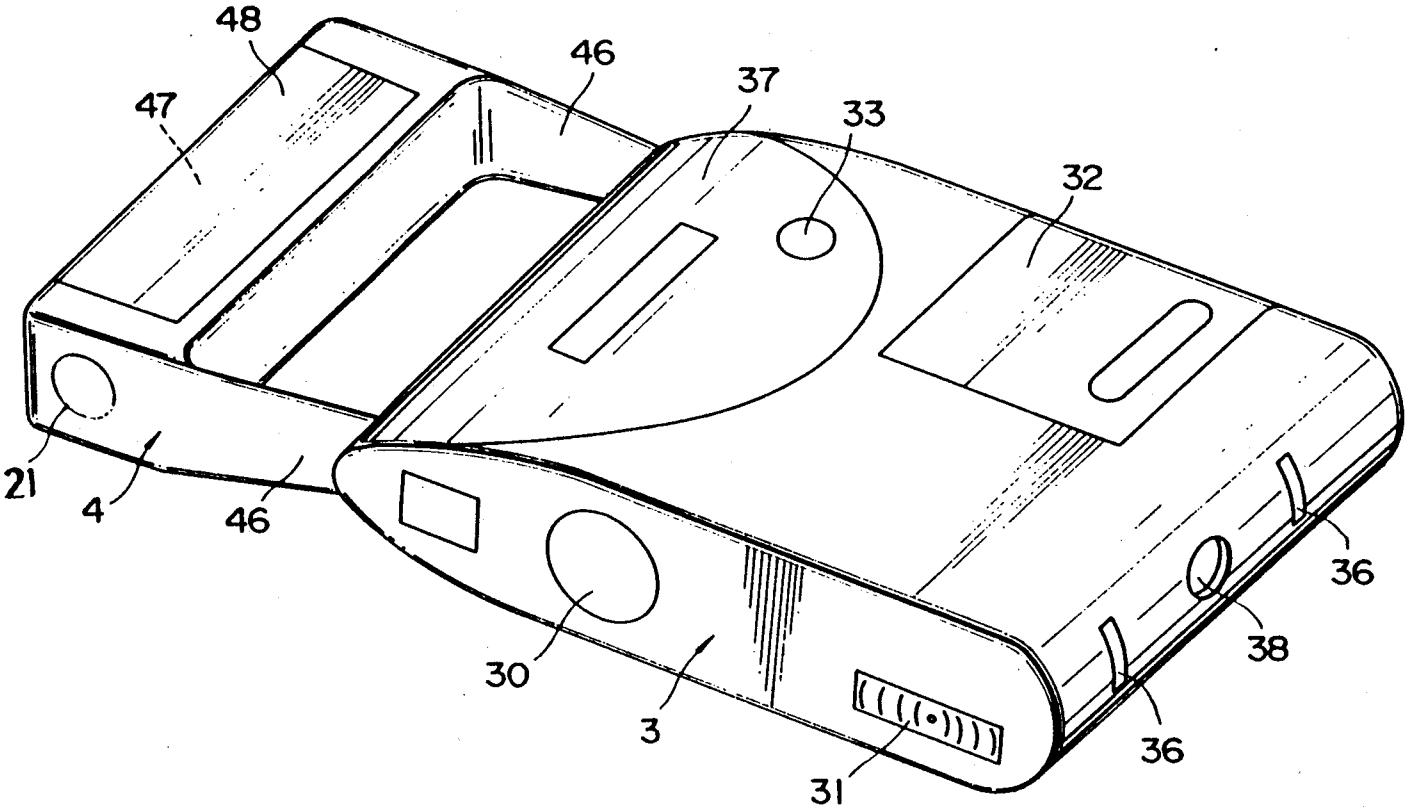
FIG. 4 is a perspective view of another still video camera embodying the present invention.

FIG. 4 shows another embodiment of the present invention. The hand strap 4 in this embodiment has a container 47 for accommodating the audio adaptor and a battery, the container 47 being protected with a cover 48. The hand strap 4 is fitted by a pair of coupling parts 46, 46 to one side of the camera body 3 by means of predetermined connecting parts, not shown (for example, screw members).

In this embodiment, a connection cord passing through the coupling parts 46 may be used to connect the audio adaptor and the camera body 3. The audio adaptor 2 may otherwise be taken out of the container 47 of the hand strap 4 and used as usual by plugging the hooks 22 in the fitting holes 36, 36.

Although it has been arranged to attach the audio adaptor to the hand strap in the embodiment shown, it may be replaced with another accessory for a still video camera. In addition, the arrangement of the electronic still video camera, the audio adaptor, the hand strap and the like according to the present invention is not limited to the above described arrangements.

As described above, the hand strap is fitted to the camera body of the still video camera and the accessories therefor are attached to the hand strap according to the present invention. Therefore, the accessories can be prevented from being lost. In case the accessory is a heavy article, moreover, the weight of the accessory is applied to the back of the hand when the camera body is held by one hand of the operator through the hand strap, whereby the camera body can be held in a well-balanced manner. In addition, the hand strap is bag-shaped so as to accommodate the connection cord, whereby it becomes possible to prevent the connection cord from obstructing the operation of the camera.

What is claimed is:

1. A still video camera with a hand strap attached to a camera body, said hand strap being arranged such that an accessory is detachably provided on said hand strap by means of a connecting member, wherein said hand strap comprises a belt-shaped member which is capable of accommodating a connection cord therein, said connection cord electrically connecting said still video camera and said accessory.

2. The still video camera according to claim 1, wherein said hand strap is arranged to enable mounting of said accessory on a side of said belt-shaped member which is opposite a side of said belt-shaped member that is connected to said camera body.

3. The still video camera according to claim 1, wherein said accessory comprises an audio adaptor.

4. The still video camera according to claim 1, wherein said connecting member comprises a pair of hook members mounted on said accessory, said hand strap extending through said hook members.

5. The still video camera according to claim 1, wherein said hand strap comprises a housing member and a pair of coupling parts for connecting said housing member and the camera body.

* * * * *